US005586083A

United States Patent [19]

Chin et al.

[11] Patent Number: 5,586,083

[45] Date of Patent: Dec. 17, 1996

[54] TURBO SIREN SIGNAL GENERATOR FOR MEASUREMENT WHILE DRILLING SYSTEMS

[75] Inventors: Wilson C. Chin, Houston; Thomas E. Ritter, Katy, both of Tex.

[73] Assignee: Harriburton Company, Dallas, Tex.

[21] Appl. No.: 296,109

[22] Filed: Aug. 25, 1994

[51] Int. Cl.[6] ..... C01V 1/40

[52] U.S. Cl. ..... 367/84; 367/912; 175/48

[58] Field of Search ..... 367/84, 912; 175/40, 175/48, 50; 324/369; 181/106, 142

[56] References Cited

U.S. PATENT DOCUMENTS

| | | | |
|---|---|---|---|
| Re. 29,734 | 8/1978 | Manning | 340/18 |
| 3,309,656 | 3/1967 | Godbey | 340/18 |
| 3,792,429 | 2/1974 | Patton et al. | 340/18 |
| 4,785,300 | 11/1988 | Chin et al. | 340/861 |
| 4,825,421 | 4/1989 | Jeter | 367/83 |
| 4,847,815 | 7/1989 | Malone | 367/84 |
| 4,914,637 | 4/1990 | Goodsman | 367/83 |
| 4,956,823 | 9/1990 | Russell et al. | 367/84 |
| 5,119,344 | 6/1992 | Innes | 367/84 |
| 5,182,731 | 1/1993 | Harlscher et al. | 367/84 |
| 5,189,645 | 2/1993 | Innes | 367/84 |
| 5,249,161 | 9/1993 | Jones et al. | 367/83 |
| 5,357,483 | 10/1994 | Innes | 367/84 |
| 5,375,098 | 12/1994 | Malone et al. | 367/83 |
| 5,375,668 | 12/1994 | Hallundbaek | 173/53 |

OTHER PUBLICATIONS

Liang, Y. J. East China Petrol. Inst., vol. 11, #4, pp. 122–136, Dec. 1987; Abst. only herewith.

Attong et al, SPE/IADC Drilling Corp. Feb. 23, 1993, pp. 149–159, abst. only herewith.

Lemartre, M., 40th Cade/Caode Spring Drilling Conf., Apr. 10, 1991, Pap. No. 91–28 (7PP); abst. only herewith.

*Primary Examiner*—Nelson Moskowitz

*Attorney, Agent, or Firm*—Conley, Rose & Tayon, P.C.

[57] ABSTRACT

A self-propelled turbo siren modulator assembly is disclosed for use in an MWD system. The turbo siren includes a fixed turbine deflector located upstream from a rotor, which in turn is located upstream from a fixed stator. Drilling mud flowing through the turbine deflector causes the rotor to rotate independent of any external drive device. The rotor and stator preferably have a similar configuration, which includes at least one lobe and at least one port so that the rotor alternatively blocks or permits mud flow through the port(s) of the stator to create a cyclical acoustic wave signal, with a frequency that depends upon the number of lobes on the rotor and the velocity of the drilling mud. Encoded measurement data is modulated on the carrier frequency wave through the use of amplitude modulation, frequency modulation or phase shift modulation, or a combination thereof to maximize data rates. In addition, a plurality of modulator assemblies may be provided, each of which includes a different number of lobes so as to operate at different, distinct frequencies to create a plurality of transmission channels in the drilling mud medium. These plurality of modulator assemblies therefore provide a plurality of separate carrier frequency signals on which data may be modulated to increase the rate at which data is transmitted to the surface of the well.

18 Claims, 7 Drawing Sheets

TURBO SIREN SIGNAL GENERATOR FOR MEASUREMENT WHILE DRILLING SYSTEMS

BACKGROUND OF THE INVENTION

The present invention relates generally to a telemetry system for transmitting data from a downhole drilling assembly to the surface of a well during drilling operations. More particularly, the present invention relates to a mud siren pressure pulse generator for use in a measurement while drilling ("MWD") system or a logging while drilling ("LWD") system to transmit downhole measurements to the surface of the well during drilling operations through the medium of the drilling fluid. Still more particularly, the present invention relates to a self-propelled mud siren for accurately and efficiently transmitting downhole drilling or borehole information to the surface.

Modern petroleum drilling and production operations demand a great quantity of information relating to parameters and conditions downhole. Such information typically includes characteristics of the earth formations traversed by the wellbore, in addition to data relating to the size and configuration of the borehole itself. The collection of information relating to conditions downhole, which commonly is referred to as "logging," can be performed by several methods. Oil well logging has been known in the industry for many years as a technique for providing information to a driller regarding the particular earth formation being drilled. In conventional oil well wireline logging, a probe or "sonde" housing formation sensors is lowered into the borehole after some or all of the well has been drilled, and is used to determine certain characteristics of the formations traversed by the borehole. The sonde is supported by a conductive wireline, which attaches to the sonde at the upper end. Power is transmitted to the sensors and instrumentation in the sonde through the conductive wireline. Similarly, the instrumentation in the sonde communicates information to the surface by electrical signals transmitted through the wireline.

More recently, those in the industry have placed an increased emphasis on the collection of data during the drilling process. By collecting and processing data during the drilling process, without the necessity of removing or tripping the drilling assembly to insert a wireline logging tool, the driller can make accurate modifications or corrections, as necessary, to optimize performance. Designs for measuring conditions downhole and the movement and location of the drilling assembly, contemporaneously with the drilling of the well, have come to be known as "measurement-while-drilling" techniques, or "MWD." Similar techniques, concentrating more on the measurement of formation parameters, commonly have been referred to as "logging while drilling" techniques, or "LWD." While distinctions between MWD and LWD may exist, the terms MWD and LWD often are used interchangeably. For the purposes of this disclosure, the term MWD will be used with the understanding that this term encompasses both the collection of formation parameters and the collection of information relating to the movement and position of the drilling assembly.

There are many systems available for transmitting data indicative of downhole parameters to the surface during the drilling of a well. One early system is that disclosed in U.S. Pat. No. 3,309,656, which used a downhole pressure pulse generator or modulator to transmit modulated signals, carrying encoded data, at acoustic frequencies to the surface through the drilling fluid or drilling mud in the drill string. In this and similar types of systems, the downhole electrical components are powered by a downhole turbine generator unit, usually located downstream of the modulator unit, that is driven by the flow of drilling fluid.

Prior art mud siren modulators typically take the form of turbine-like signal generating valves positioned in the drill string near the drill bit and exposed to the circulating drilling fluid. In many instances, the modulator assembly is comprised of a fixed stator and a motor-driven rotatable rotor, positioned coaxially with respect to each other. The stator and rotor usually are formed with a plurality of radial lobes spaced circumferentially around a central hub, so that the gaps or ports between adjacent lobes provide a plurality of openings through which the drilling fluid may flow. When the respective ports of the stator and rotor are directly aligned, the area for fluid flow through the modulator is at a maximum. As the rotor rotates with respect to the stator, and the lobes are no longer in alignment, the flow of drilling fluid is restricted, which generates pressure pulses, in the form of acoustic signals in the column of drilling fluid. As the rotor is continuously rotated with respect to the stator, a cyclic acoustic signal is produced that travels up the drilling fluid column and which is detectable at the surface of the well by the use of acoustic transducers. By selectively varying the rotation of the rotor, changes in the acoustic signal can be achieved, enabling modulation in the form of an encoded pressure pulse that can carry information indicative of downhole parameters to the surface for immediate analysis.

Depending upon whether the rotor is positioned upstream or downstream with respect to the stator greatly affects the tendencies of the rotor. The placement of the rotor upstream from the stator subjects the rotor to fluid dynamic forces due to the fluid stream that generally causes the rotor to seek a stable closed position, in which the lobes of the rotor block the ports of the stator to inhibit fluid flow through the modulator. Thus, it has been found that in this configuration, the rotor will assume a position that blocks the flow of drilling fluid whenever the rotor or the motor driving the rotor becomes inoperable. This tendency increases the likelihood that the modulator assembly will jam, as solids carried in the fluid stream are forced to flow through restricted passages in the modulator assembly. In addition, restarting the rotor is more difficult because the reduced mud flow through the modulator assembly directly affects the generation of power by the mud turbine, which is located downstream from the modulator. Prolonged modulator closing can obstruct mud flow to such an extent that lubrication of the drill bit, and other vital functions of the drilling mud, become so adversely affected that the entire drilling operation is rendered ineffective, and may even result in serious damage to the components of the bottom hole drilling assembly.

A number of methods have been investigated to overcome the problem caused by the tendency of modulator assemblies to assume a closed position. One approach, suggested for example in U.S. Pat. No. 3,792,429, is to use a magnetic force to bias the modulator assembly to an open position in the event that the rotor becomes inoperative. Magnetic attraction between a magnet attached to the modulator housing and a cooperating magnetic element positioned on the rotor shaft is used to overcome the fluid dynamic torque caused by the drilling mud stream. This method, however, has several disadvantages. First, the modulator assembly must be extended in length to accommodate the magnets.

Second, the introduction of an extraneous magnetic field downhole may potentially interfere with simultaneous measurements of the earth's magnetic field, which commonly is used to derive tool orientation.

Another method is to alter the spacing between the rotor and stator based upon the speed of the rotor. Typically, the rotor and stator are spaced very closely together to produce satisfactory acoustic signals, thus increasing the likelihood that debris in the drilling mud will become jammed or lodged in the modulator assembly. As disclosed in U.S. Pat. No. Re. 29,734, a control device is used that senses parameters indicative of the rotor slowing, such as an increase in pressure differential across the modulator assembly or an increase in the motor torque that drives the rotor. In response to these indicia of the rotor slowing, the control device temporarily separates the rotor and stator in an attempt to clear the debris from the modulator assembly by the flow of drilling mud.

A third approach is to switch the position of the stator and rotor, as suggested in U.S. Pat. No. 4,785,300, to change the tendency of the modulator assembly to assume a closed position. Placing the rotor downstream from the stator changes the stable state of the modulator assembly from a closed position, in which the lobes of the rotor align with the ports of the stator, to an open state, in which the lobes of the rotor align with the lobes of the stator. In accordance with this method, the lobes of the rotor are specially designed with an outwardly tapered configuration to enhance this effect. Because this modulator assembly assumes an open position in the absence of power to the rotor, there is less of a chance that debris will become lodged in the modulator assembly. Despite this improvement, however, and because the rotor still exhibits an inherent tendency to "freeze" (albeit, in the open position), the prior an invention disclosed in U.S. Pat. No. 4,785,300 still may be subject to debris lodging in the narrow area between the stator and rotor when the rotor ceases to rotate, causing the modulator assembly to jam when power is resumed to the rotor.

To date, no one in the industry has successfully developed a modulator assembly for a mud siren with a rotor that has an inherent tendency to continue to rotate as drilling mud flows through the modulator. Similarly, no one has developed a self-generating mud siren modulator to eliminate the necessity of a separate motor to drive the rotor, despite the apparent advantages inherent in such a design.

SUMMARY OF THE INVENTION

The present invention solves the shortcomings and deficiencies of the prior art by providing a self-propelled mud siren modulator assembly (also called a "turbo siren" modulator) for transmitting acoustic signals through the column of drilling mud to the surface of the well as part of a measurement while drilling system. The invention comprises a fixed stator, a rotatable rotor and a fixed turbine flow deflector, all mounted on a central shaft within the modulator housing. According to the preferred embodiment, the turbine flow deflector is positioned upstream from the rotor, which in turn is located upstream from the stator.

As drilling mud flows through this modulator assembly, the turbine deflects the drilling mud, causing the rotor to rotate relative to the stationary stator, without the necessity of a power source to drive the rotor. Both the stator and rotor are configured with at least one lobe for blocking the flow of drilling mud, and at least one port through which drilling mud may pass. Rotation of the rotor relative to the stator varies the flow of drilling mud through the modulator assembly as the lobe(s) of the rotor changes alignment with the lobe(s) and port(s) of the stator. This variation in the flow of drilling mud through the modulator assembly generates a pressure fluctuation which is transmitted via an acoustic wave signal through the medium of the drilling mud to the surface of the well, where the signal can be detected by an acoustic transducer. Encoded data can be modulated on the carrier acoustic wave signal by varying the amplitude, frequency or phase of the acoustic wave carrier signal.

The configuration of the modulator assembly, and the relative placement of the turbine deflector, rotor and stator are such that the fluid dynamic forces which are established in response to the flow of drilling mud within the modulator housing causes an inherent tendency for the rotor to rotate at an angular velocity that is proportional to the velocity of the drilling mud. Because of this tendency of the rotor to independently and continuously rotate, no separate drive mechanism is required to operate the rotor. Furthermore, because the rotor continuously rotates, there is less of a likelihood that debris will clog the modulator assembly.

According to the preferred embodiment, the rotor and stator are constructed as substantially identical structures, with the same number and configuration of lobes and ports. Moreover, the lobes and ports preferably are configured to be substantially the same size and shape. The number of lobes used affects the frequency (and to some extent the amplitude) of the acoustic wave signal generated. Typically, the more lobes that are provided on the rotor, the higher will be the frequency of the acoustic wave. The frequency of the modulator assembly may be modified to modulate data on the acoustic wave carrier signal by momentarily slowing the angular velocity of the rotor, thereby decreasing the frequency of the acoustic wave signal for a particular interval period. The status of the acoustic signal frequency in any single interval determines the information encoded in that interval. A plurality of intervals comprise the transmission period, with each interval comprising a "bit" of the transmission signal.

Alternatively, the phase of the acoustic carrier wave signal may be modified to modulate data on the carrier wave. In this embodiment, the rotor is instantaneously slowed down or speeded up, or stopped and started in a jogged manner to shift the phase of the carrier signal sine wave.

As yet another alternative, the amplitude of the carrier acoustic wave signal may be modulated to encode data thereon. The amplitude of the acoustic wave signal is determined, at least partially, by the spacing between the stator and rotor. As the spacing between the rotor and stator becomes smaller (up to a minimum threshold spacing), the amplitude of the acoustic wave signal becomes larger. Thus, data can be modulated on the acoustic wave carrier signal by momentarily modifying the spacing between rotor and stator to change the amplitude of the acoustic carrier wave in any predetermined interval period. Alternatively, to increase the quantity of data that can be transmitted in the mud column, multiple types of modulation can be used to increase the rate at which data is transmitted to the surface.

In one embodiment of the invention, a plurality of turbo siren modulator assemblies may be mounted serially on the same shaft to increase the data rate, or to provide a redundant system to minimize transmission errors. In this embodiment, each of the modulator assemblies would operate at different frequencies, by changing the number of lobes on the associated rotor and stator pair. Thus, if two turbo siren modulator assemblies were used, the first assembly, for example, could use six lobes, and the second assembly could use three lobes, to provide two different distinct carrier frequency acoustic waves in the column of drilling mud. Thus, each turbo siren modulator assembly represents an additional data transmission channel in the mud column medium.

BRIEF DESCRIPTION OF THE DRAWINGS

For a more detailed description of the preferred embodiment of the present invention, reference will now be made to the accompanying drawings, wherein.

During the course of the following description, the terms "upstream" and "downstream" are used to denote the relative position of certain components with respect to the direction of flow of the drilling mud. Thus, where a term is described as upstream from another, it is intended to mean that drilling mud flows first through the first component before flowing through the second component. Similarly, the terms such as "above," "upper" and "below" are used to identify the relative position of components in the bottom hole assembly, with respect to the distance to the surface of the well, measured along the borehole path.

DETAILED DESCRIPTION OF THE PREFERRED EMBODIMENT

Figure 1:
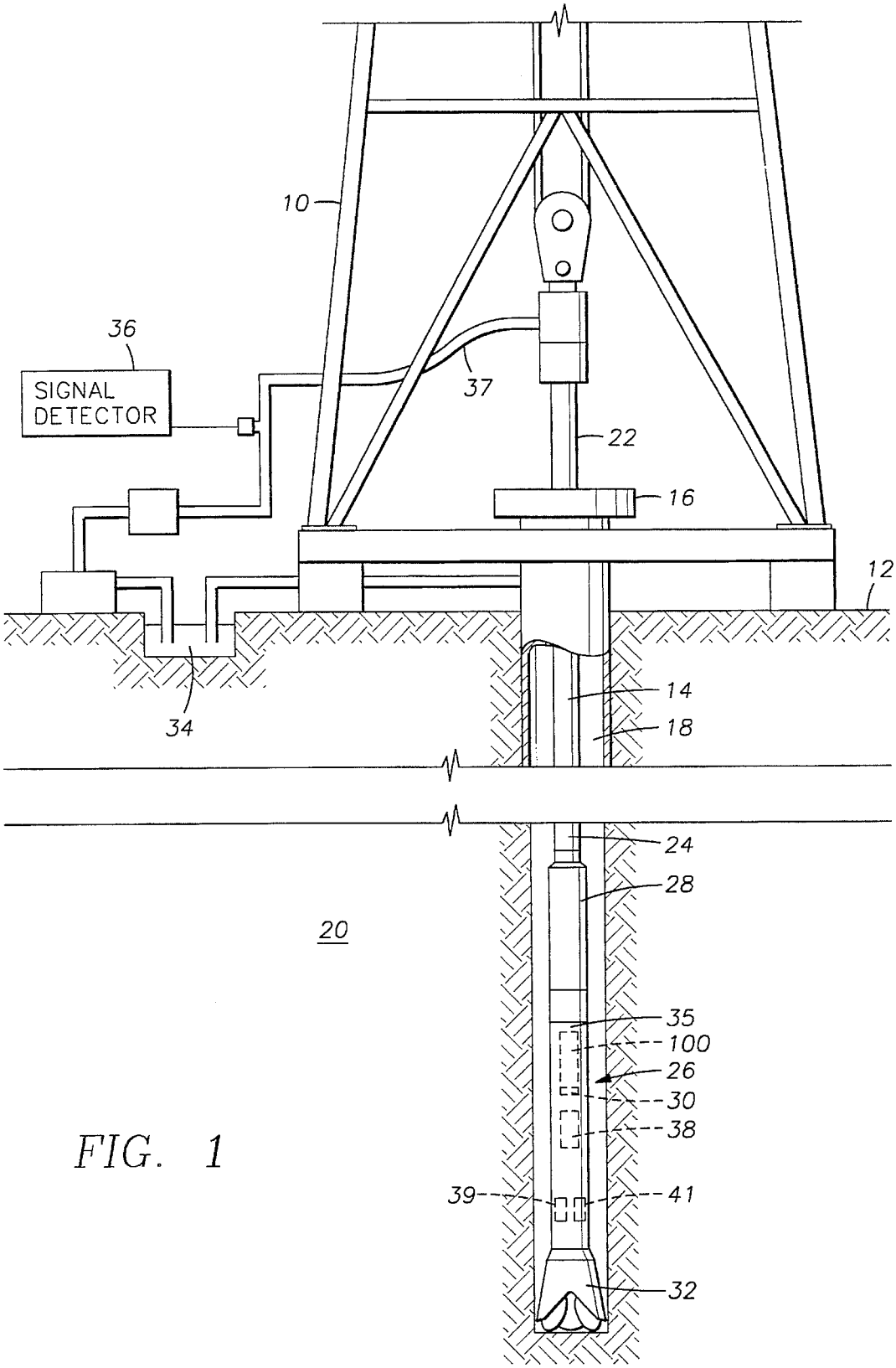
FIG. 1 is a schematic view of a drilling assembly implementing a mud siren modulator assembly as part of a measurement while drilling (or "MWD") system in accordance with the present invention.

Referring now to FIG. 1, a typical drilling installation is illustrated which includes a drilling rig 10, constructed at the surface 12 of the well, supporting a drill string 14. The drill string 14 penetrates through a rotary table 16 and into a borehole 18 that is being drilled through earth formations 20. The drill string 14 includes a kelly 22 at its upper end, drill pipe 24 coupled to the kelly 22, and a bottom hole assembly 26 (commonly referred to as a "BHA") coupled to the lower end of the drill pipe 24. The BHA 26 typically includes drill collars 28, a MWD tool 30, and a drill bit 32 for penetrating through earth formations to create the borehole 18. In operation, the kelly 22, the drill pipe 24 and the BHA 26 are rotated by the rotary table 16. Alternatively, or in addition to the rotation of the drill pipe 24 by the rotary table 16, the BHA 26 may also be rotated, as will be understood by one skilled in the art, by a downhole motor. The drill collars are used, in accordance with conventional techniques, to add weight to the drill bit 32 and to stiffen the BHA 26, thereby enabling the BHA 26 to transmit weight to the drill bit 32 without buckling. The weight applied through the drill collars to the bit 32 permits the drill bit to crush and make cuttings in the underground formations.

As shown in FIG. 1, the BHA 26 preferably includes a measurement while drilling system (referred to herein as "MWD") tool 30, which may be considered part of the drill collar section 28. As the drill bit 32 operates, substantial quantities of drilling fluid (commonly referred to as "drilling mud") are pumped from a mud pit 34 at the surface through the kelly hose 37, into the drill pipe, to the drill bit 32. The drilling mud is discharged from the drill bit 32 and functions to cool and lubricate the drill bit, and to carry away earth cuttings made by the bit. After flowing through the drill bit 32, the drilling fluid rises back to the surface through the annular area between the drill pipe 24 and the borehole 18, where it is collected and returned to the mud pit 34 for filtering. The circulating column of drilling mud flowing through the drill string also functions as a medium for transmitting pressure pulse acoustic wave signals, carrying information from the MWD tool 30 to the surface.

Typically, a downhole data signalling unit 35 is provided as part of the MWD tool 30 which includes transducers mounted on the tool that take the form of one or more condition responsive sensors 39 and 41, which are coupled to appropriate data encoding circuitry, such as an encoder 38, which sequentially produces encoded digital data electrical signals representative of the measurements obtained by sensors 39 and 41. While two sensors are shown, one skilled in the art will understand that a smaller or larger number of sensors may be used without departing from the principles of the present invention. The sensors are selected and adapted as required for the particular drilling operation, to measure such downhole parameters as the downhole pressure, the temperature, the resistivity or conductivity of the drilling mud or earth formations, and the density and porosity of the earth formations, as well as to measure various other downhole conditions according to known techniques. See generally "State of the Art in MWD," International MWD Society (Jan. 19, 1993).

The MWD tool 30 preferably is located as close to the bit 32 as practical. Signals representing measurements of borehole dimensions and drilling parameters are generated and stored in the MWD tool 30. In addition, some or all of the signals also may be routed through a mud pulse modulator assembly in the drill string 14 to a control unit 36 at the earth's surface 12, where the signals are processed and analyzed.

In accordance with the preferred embodiment of this invention, the data signalling unit 35 preferably includes a modulator assembly 100 to selectively interrupt or obstruct the flow of drilling mud through the drill string 14, to thereby produce digitally encoded pressure pulses in the form of acoustic wave signals. The modulator assembly 100 is selectively operated in response to the data encoded electrical output of the encoder 38 to generate a corresponding encoded acoustic wave signal. This acoustic signal is transmitted to the well surface through the medium of the drilling mud flowing in the drill string, as a series of pressure pulse signals, which preferably are encoded binary representations of measurement data indicative of the downhole drilling parameters and formation characteristics measured by sensors 39 and 41. These binary representations preferably are made through the use of modulation techniques on a carrier acoustic wave, including amplitude, frequency or phase-shift modulation. The presence or absence of modulation in a particular interval or transmission bit preferably is used to indicate a binary "0" or a binary "1" in accordance with conventional techniques. When these pressure pulse signals are received at the surface, they are detected, decoded and converted into meaningful data by a conventional acoustic signal detector (not shown).

Figure 2:
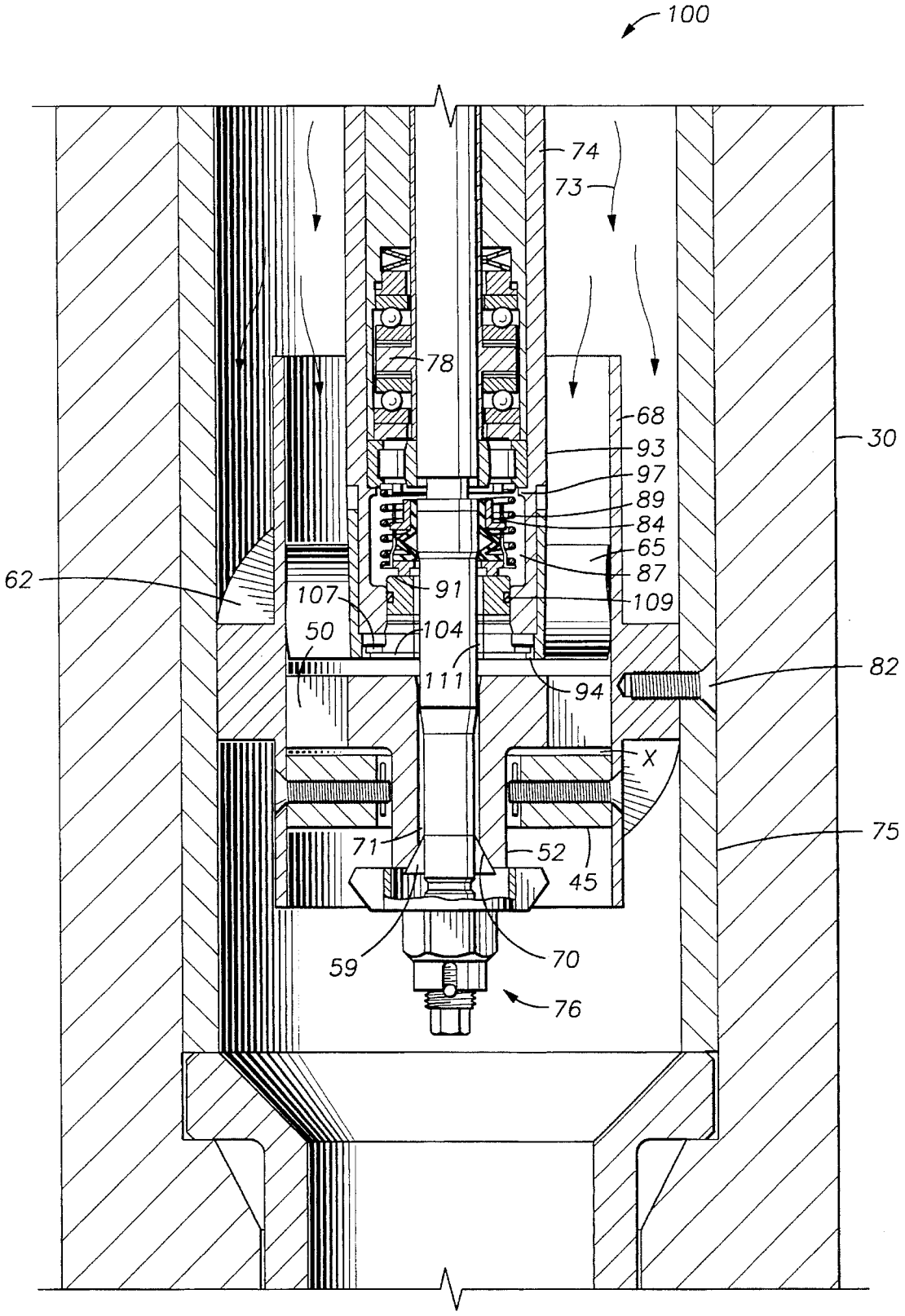
FIG. 2 is a side view, partially in section, of the turbo siren modulator assembly of FIG. 1 constructed in accordance with the preferred embodiment.
Figure 3:
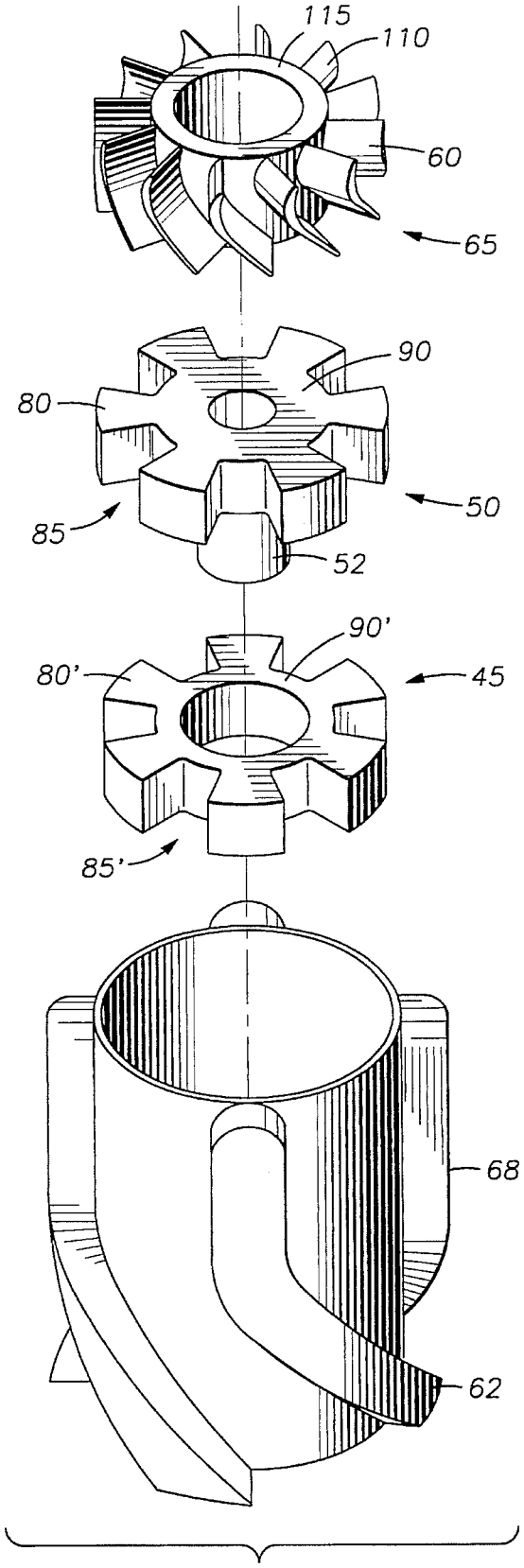
FIG. 3 is a perspective view of the turbo siren of FIGS. 1 and 2.

Referring now to FIGS. 2 and 3, the modulator assembly 100 preferably comprises a fixed stator 45, a rotatable rotor 50 and a fixed turbine deflector 65 mounted on a central shaft 71 within a generally cylindrical modulator housing 75. In accordance with the preferred embodiment, a generally cylindrical diverter or bypass unit 68 mounts to the interior surface of the modulator housing 75, with the turbine 65, rotor 50 and stator 45 all preferably mounted within the interior of the diverter unit 68. Accordingly, drilling mud flows into the housing 75 as shown by arrows 73, and is diverted to flow both inside and outside the diverter unit 68. The flow of drilling mud inside the diverter 68 then is deflected by the turbine 65 causing the rotor 50 to rotate relative to the stator 45, producing a cyclical pressure pulse in the column of drilling mud that can be detected at the surface by a signal detector unit 36, according to conventional techniques.

The modulator housing 75 preferably mounts within the MWD drill collar 30 (FIG. 1) of the bottomhole assembly ("BHA") according to conventional techniques. The diverter or bypass unit 68 preferably has a generally cylindrical configuration and is maintained in position within the housing 75 by a plurality of set screws or lock screws 82 that extend through the housing 75 and into the diverter 68. The screws 82 preferably are equally spaced around the circumference of the housing 75. The diverter unit 68 preferably includes a plurality of spiralling ribs 62 on the exterior surface of the diverter, causing the drilling mud to flow more slowly past the exterior surface of the diverter 68, creating a high pressure on the exterior side of the diverter that forces drilling mud to flow into the interior of the diverter unit 68 and thus through the turbine 65, rotor 50 and stator 45.

Figure 5A:
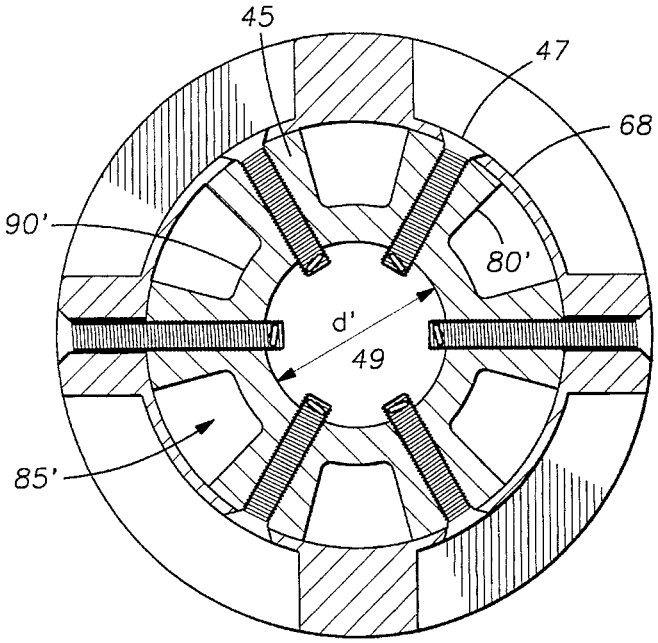
FIGS. 5A–5B are top elevations of a rotor and stator of a turbo siren that are configured with six lobes and six ports.
Figure 6B:
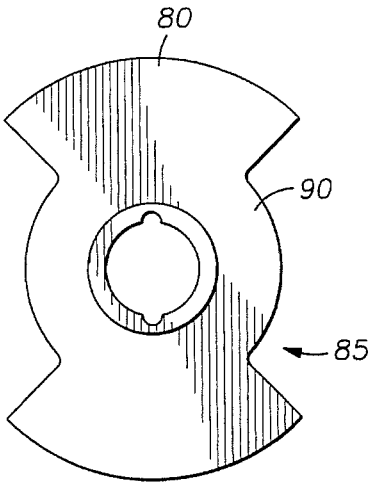
FIGS. 6A–6B depict alternative configurations of the rotor for the turbo siren that are configured with three and two lobes, respectively.
Figure 5B:
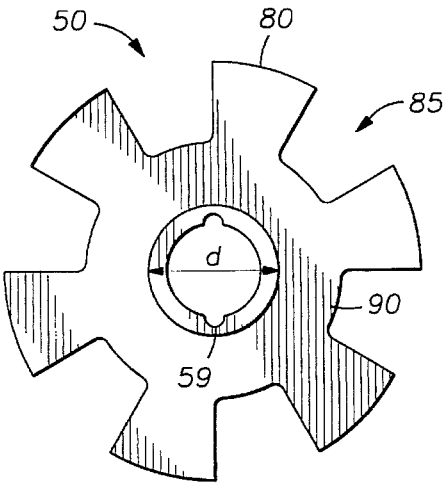
Figure 6A:
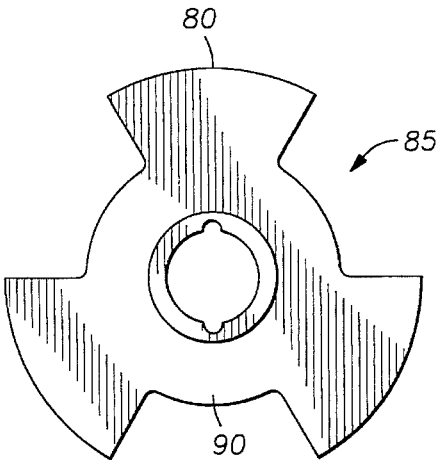

According to the preferred embodiment, and as shown in FIGS. 3, 5 A and 5B, the rotor 50 and stator 45 include at least one lobe 80 (identified as 80' in the stator) and at least one port 85 (identified as 85' in the stator) around a central hub section 90 (90' in the stator). Preferably, the stator and rotor have generally the same configuration and dimensions, except that the rotor 50 includes an annular flange 52 and a smaller inner diameter than the stator. In addition, in the preferred embodiment, and as shown for example in FIGS. 5A, 5B, 6A and 6B, the lobes and ports of the rotor and stator are configured to have substantially the same surface area with respect to the mud stream. Thus, as seen in FIG. 6A for a three lobe configuration, both the lobes and ports each extend along an arc of 60° from the central hub section 90. The number of lobes on the rotor 50 and stator 45 define the number of pulses that will be generated during one revolution of the rotor 50. Thus, for example, if the rotor and stator have six lobes, then six pressure pulses are generated in one revolution of the rotor. The preferred dimensions of the rotors shown in FIGS. 5A (six lobes), 6A (three lobes) and 6B (two lobes) are as follows:

TABLE I (PREFERRED DIMENSIONS)

ROTOR WITH 6 LOBES
Diameter of hub section=1.72"
Inner diameter=0.6257"
Angular width of lobes=30°
Angular width of ports=30°
Depth of lobes=0.541"

ROTOR WITH 3 LOBES
Diameter of hub section=1.72"
Inner diameter=0.6257"
Angular width of lobes=60°
Angular width of ports=60°
Depth of lobes=0.541"

ROTOR WITH 2 LOBES
Diameter of hub section=1.72"
Inner diameter=0.6257"
Angular width of lobes=90°
Angular width of ports=90°
Depth of lobes=0.541"

These dimensions are only meant to be illustrative of the preferred embodiment and should not be construed as a limitation on the number and dimensions of the rotor and stator configurations. One skilled in the art will understand that other configurations may be used without departing from the principles of the present invention.

Referring again to FIGS. 2, 3, 5A and 5B, the stator 45 includes one or more lobes and one or more ports, and preferably has an inner diameter d' that is sufficiently large to accommodate the rotor hub 52. The exterior diameter of the lobes 80' is designed to fit within the interior of the diverter unit 68. The stator 45 is fixedly attached to the lower interior surface of the diverter 68 by a plurality of screws 47, that extend through a passage 49 positioned centrally in some or all of the stator lobes.

The rotor 50 preferably includes a hub section 52 and one or more lobes 80 and one or more ports 85 around a central hub 90. The hub 52 extends from the inner hub portion 90 of the rotor 50 and includes a plurality of keys 59 on the interior portion of the hub section 52 that lock rotor 50 to driveshaft 71. The hub 52, according to the preferred embodiment, has an external diameter d that is smaller than the inner diameter d' of the stator 45, thereby permitting the hub section 52 to be positioned within the inner diameter of the stator 45. According to the preferred embodiment, the rotor 50 is positioned within the interior of the diverter 68 and upstream from the stator, with a certain minimum spacing x between the rotor 50 and stator 45. One skilled in the art will understand that the spacing x should be optimally selected to generate an acoustic signal with a sufficient amplitude, without generating a signal with an excessively high amplitude, which could result in erosive deterioration of the rotor and stator.

Referring again to FIG. 2, the central shaft 71 rotates within non-rotating section 74, with a a bearing section 78 connecting the rotating shaft 71 to the non-rotating section 74. Alternatively, one skilled in the art will understand that other arrangements for the shaft 71 are available, including a uniformly non-rotating shaft with a bearing assembly for accommodating rotation of the rotor 50. Thus, the following description of the shaft 71 is only meant to be illustrative of the preferred embodiment, and should not be construed as limiting the present invention to such a shaft configuration.

In the preferred embodiment, shaft 71 is positioned concentrically within the inner diameter of the stator 45 and rotor 50, and includes recesses 70 that mate with keys 59 for transmitting the rotation of the rotor 50 to the shaft section 71. In addition, a nut assembly 76 mounts to the lower end of the shaft section 71 for limiting the axial movement of the rotor 50 and for securing the shaft and rotor together. The center of the rotating shaft section 71 attaches along its outer periphery to a rubber seal 84, which is bonded to a spring assembly 89 in chamber 87. The spring assembly 89 functions to provide an axial force on a seal assembly 91. The upper end of the driveshaft 71 preferably connects to the bearing section 78.

Referring still to FIG. 2, the upper non-rotating housing section 74 preferably is positioned concentrically around the outside of the rotating shaft section 71 at the middle and upper ends thereof. The non-rotating section 74 generally comprises a tubular housing 93 and a lower cap assembly 94. The tubular housing 93 extends generally along the length of the non-rotating shaft, and includes an internal shoulder 97 for maintaining the bearing section 78 in position. The lower cap assembly 94 generally includes a cap 104, secured against the tubular housing 93 by bolts 107. An O-ring 109 preferably is used to seal chamber 87 from passage 111, which contains drilling mud. The bearing section 78, in accordance with conventional techniques, preferably includes various thrust, roller and ball bearings to facilitate rotation of the rotating shaft section 71 within the non-rotating shaft section.

Referring now to FIGS. 2 and 3, the turbine deflector 65 preferably is positioned upstream from the rotor 50, within the diverter unit 68. In the preferred embodiment, the turbine is fixed to prevent rotation by securing the turbine to the lower exterior surface of the non-rotating shaft section 74. Alternatively, or additionally, the turbine may be secured against the interior surface of the diverter 68 in the same manner as the stator 45. The turbine preferably comprises a plurality of fins 110 that are arranged uniformly about the body 115 of the turbine, and which spirals around the exterior of the body 115 for deflecting the direction of mud flow as it passes outside the diverter structure.

In operation, the drilling mud flows into the modulator assembly 100 as shown by the arrows 73. Some of the drilling mud is diverted by the diverter unit 68 into the interior thereof, and flows through the turbine deflector 65. The direction of the mud is changed by the deflector 65, causing the rotor 50 to rotate without the necessity of a separate drive mechanism. As the rotor 50 spins in response to the flow of drilling mud, and as will be understood by one skilled in the art, an acoustic pressure pulse is generated in the column of mud that can be detected at the surface by signal detecting unit 36. This acoustic signal preferably serves as a carrier wave signal which can be modulated to encode data thereon. The angular velocity of the rotor 50, and thus the frequency of the modulator assembly 100, is a function of the velocity of the drilling mud through the modulator assembly 100. The frequency of the modulator assembly 100 also is dependent on the number of lobes and ports provided on the rotor 50 and stator 45. The greater the number of lobes, the higher the frequency of the modulator assembly.

As will be understood by one skilled in the art, downhole information can be encoded on the acoustic carrier signal in many ways. In accordance with the preferred embodiment, a modulating device connects to the rotor 50 to control the speed and/or rotation of the rotor to modify the characteristics of the mud pulse signal. The modulating device can comprise a hydraulic device, an electric device, a friction brake, a mechanical ratchet, or any other type of device that is capable of controlling the speed or rotation of the rotor. The modulating device preferably responds to signals from the encoder 38 (indicative of the output of sensors 39, 41), and provides an instantaneous slow down or speed up of the rotor, or momentarily stops and starts the rotor in an alternating manner.

The pressure pulses generated by the modulator assembly 100 typically are in the form of sine waves or discrete pulses. One possible technique is to implement frequency modulation (also referred to as frequency shift keying or "FSK") by slowing the rotor 50 to encode data through the use of a brake mechanism (described in more detail below with respect to FIG. 7C). Thus, if the modulator assembly 100 operates at 25 Hz, for example, the rotor 50 may be slowed to operate momentarily at 15 Hz to encode data on the 25 Hz carrier signal. Typically, the transmission of acoustic signals is divided into a plurality of intervals (each of which has a uniform duration of, for example, one second). The presence of a 15 Hz signal (as opposed to the carrier 25 Hz signal) during a particular transmission interval or "bit" could signify either a digital "0" or a digital "1" as desired. Alternatively, three or more distinct frequency levels could be used to encode the data in one of three ways to increase the rate at which data can be transmitted.

Another technique that can be implemented with the present invention is to encode downhole information on the carrier signal through the use of amplitude modulation. The amplitude of the acoustic signal is a function of the distance x between the rotor 50 and the stator 45. As a result, the stator 45 may be moved momentarily with respect to the rotor 50 to a position x', thereby changing the amplitude of the signal that is transmitted. An example of a modulator assembly implementing amplitude modulation with the present invention is shown in FIG. 7D and described in more detail below.

Still another technique that may be used to encode information on the carrier signal is to phase shift (also referred to as phase shift keying or "PSK") the acoustic signal as discussed in U.S. Pat. No. 4,785,300 by momentarily altering the rotation of the rotor 50. In phase-shift keying with continuous sine waves, the change in phase could be coded as a binary "1," while the absence of a change in phase could represent a binary "0." Examples of modulating devices implementing phase shift keying are shown and described with respect to FIGS. 7A and 7B. As one skilled in the art will understand, other modulation techniques also may be used in addition to those disclosed to encode downhole information on the carrier signal.

To increase data rate, the carrier signal may be modulated using various combinations of modulation techniques. Thus, for example, both frequency modulation and amplitude modulation may be used to increase the amount of information that can be transmitted in each interval (or transmission bit). The use of two forms of modulation (each of which has two states) effectively doubles the data rate by providing four possible values ($2^2=4$) for each interval, instead of only two possible values for the interval.

Figure 7A:
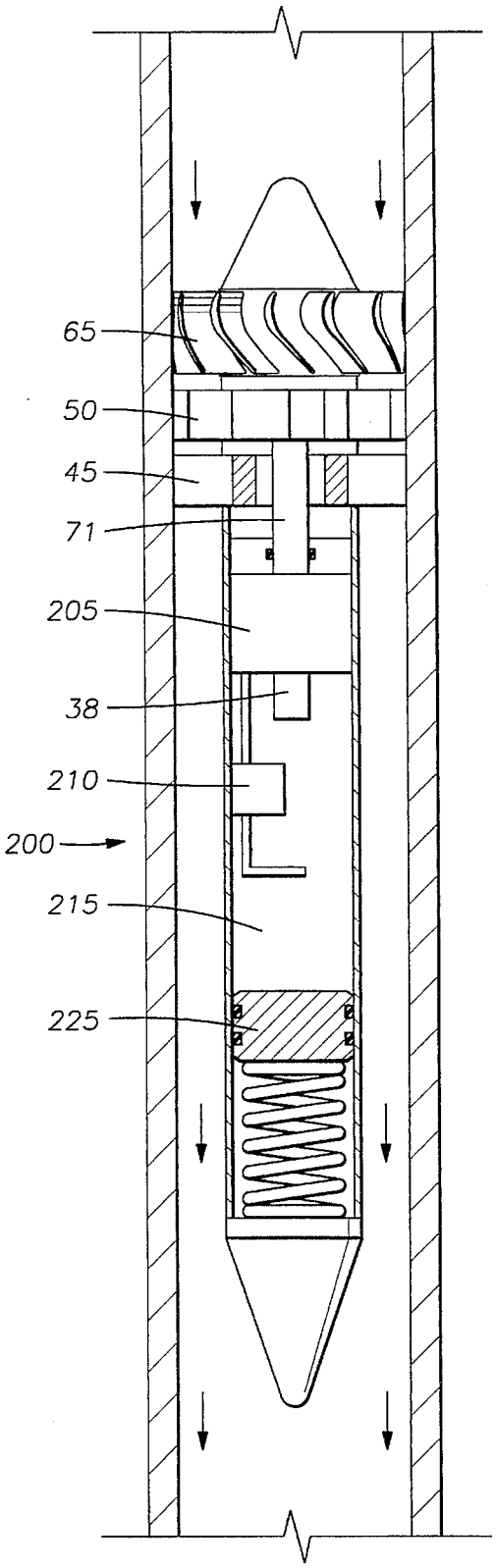
FIGS. 7A–7D illustrate alternative arrangements for modulating the mud pulse carrier signal generated by the modulator assembly of FIG. 1.

FIG. 7A shows a modulating assembly implementing a hydraulic speed control modulating device 200 with a rotor 50 and stator 45. The hydraulic speed control modulating device 200 preferably includes an encoder 38, a hydraulic pump 205, an electrohydraulic flow control valve 210, and a hydraulic reservoir 215. In accordance with this embodiment, the driveshaft portion 71 of rotor 50 connects directly to the hydraulic pump 205 and to the encoder 38. The pump 205 draws fluid from the hydraulic reservoir 215 and pumps the hydraulic fluid through the flow control valve 210, and back again to the reservoir 215. The flow control valve 210 receives coded signals from sensors 39, 41 (FIG. 1) through the encoder 38 and interrupts the flow of hydraulic fluid, causing the rotor 50 to slow down or speed up, as desired. In the preferred embodiment, the pump 205 is driven by the rotor 50. As the flow control valve 210 restricts the flow of hydraulic fluid through the pump 205, the pump pressure increases, which in turn increases the torque necessary to drive the pump 205. As the torque required to drive the pump increases, the rotor 50 slows down. As a result, the transmitted mud pulse pressure signal, in the form of a sine wave, experiences a change in phase each time the rotor speed is changed by the interruption of hydraulic fluid by the flow control valve. In addition, and in accordance with conventional techniques, a hydrostatic pressure balance piston 225 is provided to equalize the pressure within the modulating device with the ambient pressure.

Figure 7B:
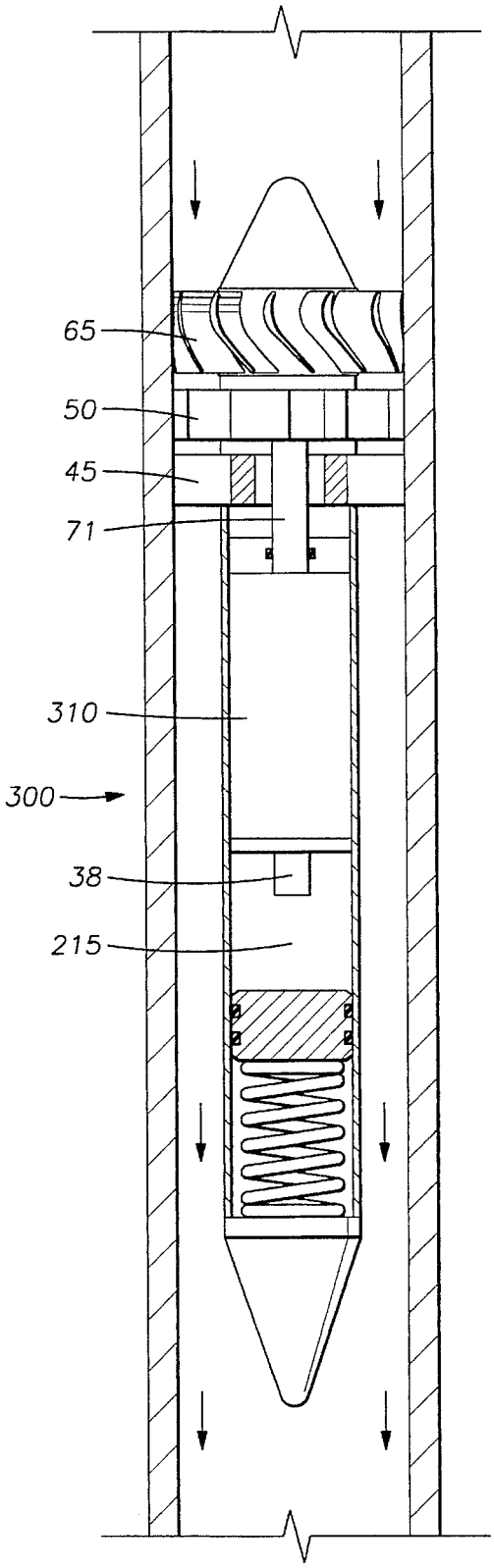

FIG. 7B depicts an alternative embodiment implementing an electric generator modulating device 300 connected to the driveshaft 71 of rotor 50. The electric generator modulating device 300 preferably includes a generator 310, a variable controlled resistor (not shown) that is provided as a load on the generator 310, and encoder 38. By changing the resistance of the variable controlled resistor in response to the signals from encoder 38, the torque of the generator also changes, causing the rotor 50 to slow down or speed up. Thus, as the resistive load on the generator increases, so too does the torque necessary to drive the generator, thereby causing the rotor 50 to slow down. As the rotor speed is modified, the phase of the pressure pulse is altered.

Figure 7C:
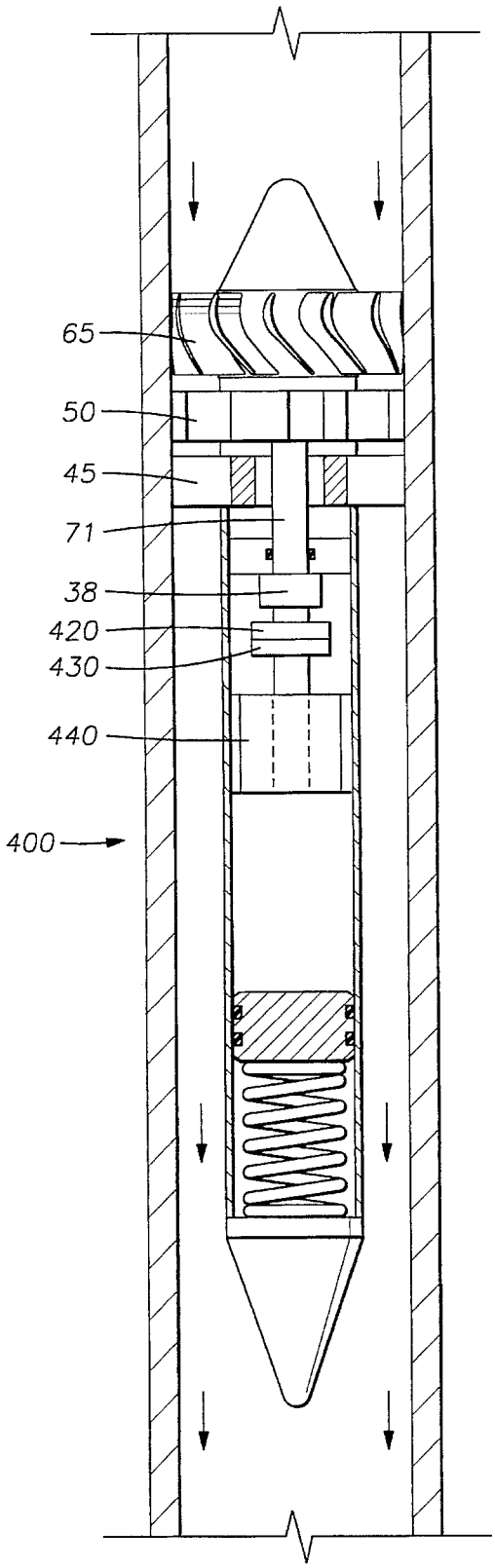
Figure 7D:
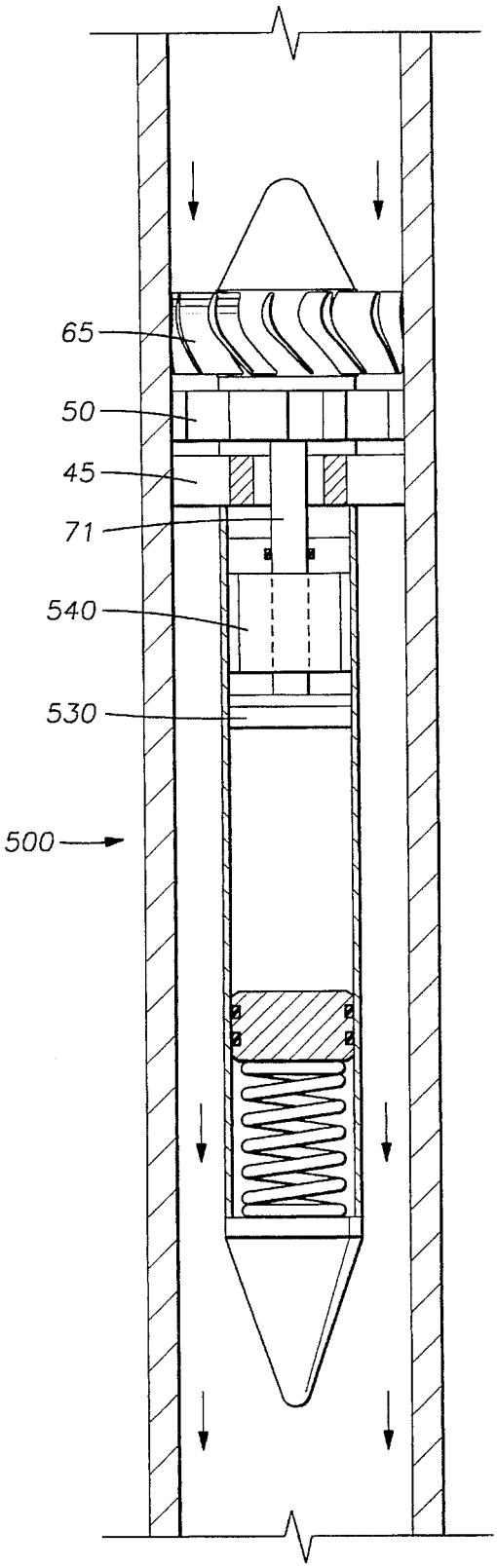

FIG. 7C shows another alternative embodiment for the modulating device. In FIG. 7C a friction brake modulating device 400 is shown connected to the driveshaft 71 of the rotor 50 that includes a brake rotor disc 420, a caliper stator 430, the encoder 38, and a force actuator 440. In accordance with this embodiment, the force actuator 440 receives output signals from the encoder 38, and in response forces the caliper stator 430 into frictional contact with the rotor 420, causing the rotor 50 to slow down. In this embodiment, the mud pulse signal that is transmitted can be either phase or frequency modulated by changing the speed of the rotor 50 through the brake mechanism.

FIG. 7D shows yet another embodiment of a modulating device that can be implemented in accordance with the principles of the present invention. FIG. 7D illustrates an axial reciprocating rotor modulating device 500 that connects to the driveshaft 71 of rotor 50. The rotor modulating device 500 includes a force actuator connected to the driveshaft portion 71 of rotor 50 and a constant speed regulator 530. The force actuator 540 is energized in response to signals from the encoder 38, causing the driveshaft portion 71 of rotor 50 to move axially so that the rotor 50 moves closer to or further from stator 45. As the rotor 50 is positioned more closely to stator 45, the amplitude of the mud pulse signal increases. Conversely, as the rotor 50 is moved further from the stator 45, the amplitude of the pressure pulse signal decreases. By selectively positioning the rotor axially, a method is provided for encoding data on a mud pressure pulse carrier wave.

As one skilled in the art will understand, other types of modulating devices are available for encoding data on the carrier mud pulse signal. One type of modulating device (not shown) which also could be used includes a ratcheting mechanism that enables the rotor to move incrementally a notch at a time. In this embodiment, a notch is provided for each lobe of the rotor, so that the modulator is opened or shut during each interval by advancing the rotor one notch, or by selectively not advancing the rotor. Such a ratcheting mechanism preferably would stop the rotor in an open position with respect to the stator. As the rotor is advanced, the lobes of the rotor would interrupt the flow of mud to produce a discrete pressure pulse. Thus, a high pressure pulse is generated each time the rotor is advanced to provide a binary signal that can be detected at the surface. By coding the high pressure pulse as a binary "1," for example, and the low pressure signal as a binary "0," a method is available to transmit data to the surface. The ratchet mechanism could be activated by a solenoid or similar mechanical device. The pulse rate of the modulator assembly so constructed would be limited only be the rate at which the ratchet latching mechanism could be activated, or by the rotational speed of the rotor, which would depend upon the mud flow rate.

The foregoing discussion has focused on a modulator assembly 100 capable of producing a cyclical acoustic signal by a self-propelled turbo siren device comprising a turbine 65, a rotor 50 and a stator 45. Because the mud siren of the present invention is self-propelled, without the necessity of a downhole power source to operate the rotor, a plurality of mud siren modulator assemblies may be mounted in series or in parallel in the MWD tool 30 to provide multiple transmission channels or to provide redundant systems to eliminate error.

Figure 4:
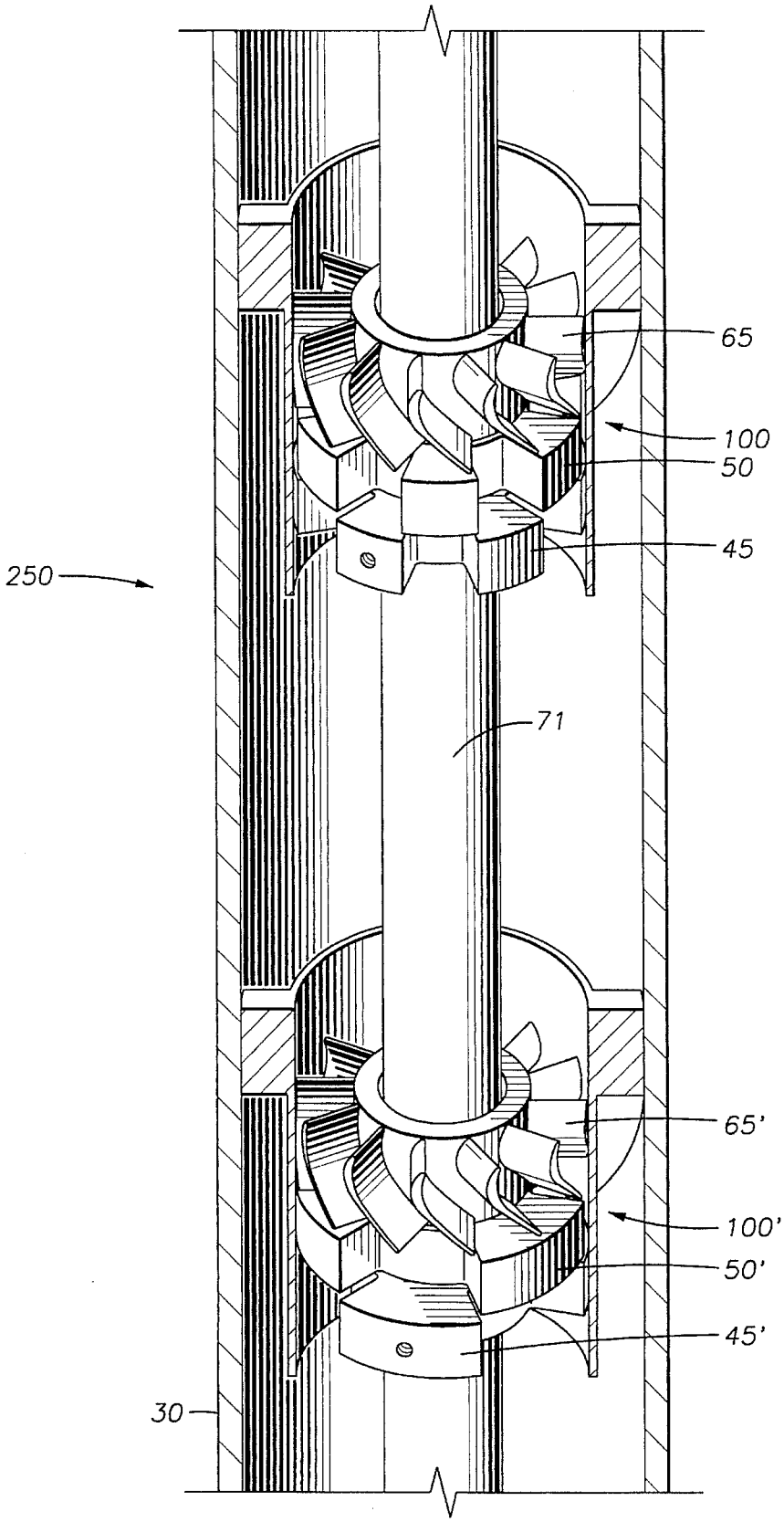
FIG. 4 is a perspective view of a MWD system implementing a plurality of turbo siren modulator assemblies in accordance with one embodiment of the present invention.

Referring now to FIG. 4, a multiple transmission channel modulator 250 is shown which preferably includes two or more modulator assemblies 100, 100'. One skilled in the art will understand that more than two modulator assemblies could be implemented if desired to increase the number of transmission channels. According to this embodiment, the modulator assemblies 100, 100' are mounted in series on the same shaft 71, which includes rotating and non-rotating sections, as discussed above, or which is uniformly non-rotating. Alternatively, the modulator assemblies could be mounted in parallel on different shafts (not shown).

As discussed above, the number of lobes on the rotor and stator establishes the frequency of the modulator assembly. As such, the present invention can be used as part of a downhole telemetering system that is capable of providing multiple transmission signals in the mud column medium. In accordance with this embodiment of the invention and as shown in FIG. 4, two or more modulator assemblies 100, 100' are provided in the MWD tool 30, each operating at different frequencies. To operate at different frequencies, each of the modulator assemblies 100, 100' includes rotors 50, 50' and stators 45, 45' with different numbers of lobes. In the preferred embodiment, both modulator assemblies include a turbine 63, 65. Thus, for example in the two modulator system of FIG. 4, the first assembly 100 could, for example, include a rotor 50 and a stator 45 with six lobes, while the second assembly 100' could, for example, include a rotor 50' and a stator 45' with three lobes. In this manner, each of the modulator assemblies 100, 100' would operate at different frequencies to provide two separate transmission channels in the drilling mud. Each of these distinct signals generated by the modulator assemblies 100, 100' can then be used as a carrier signal for modulation purposes.

To further increase the data rate of transmissions on the multiple channel system of FIG. 4, multiple forms of modulation (amplitude, frequency, phase shift, etc.) may be used in combination with the multiple transmission channels, or additional modulator assemblies could be used which operate at different frequencies.

While a preferred embodiment of the invention has been shown and described, modifications thereof can be made by one skilled in the art without departing from the spirit of the invention.

We claim:

1. A modulator assembly for an MWD system, comprising;

an outer housing;

a stator fixedly positioned within said housing;

a rotor positioned upstream from said stator; and a turbine fixedly positioned upstream from said rotor;

said rotor being rotatable independently of said stator and said turbine.

2. An assembly as in claim 1, further comprising a shaft on which said stator, rotor and turbine are mounted.

3. An assembly as in claim 1, wherein drilling mud flows through said modulator assembly, forcing said rotor to continuously rotate.

4. An assembly as in claim 3, further comprising an encoder for controlling the speed at which said rotor rotates.

5. An assembly as in claim 1, wherein the rotor and stator are displaced a distance x.

6. An assembly as in claim 5, wherein the modulator assembly produces an acoustic signal with a particular amplitude, and the distance between the rotor and stator is momentarily altered to modulate the amplitude of the acoustic signal to encode data on the acoustic signal.

7. An assembly as in claim 6, further comprising a force actuator connected to the rotor for axially moving the rotor closer to and further from the stator.

8. An assembly as in claim 4, wherein the modulator assembly produces an acoustic signal at a particular frequency, and the frequency of the rotor is altered to modulate the frequency of the acoustic signal to encode data on the acoustic signal.

9. An assembly as in claim 8, further comprising a friction brake connected to the rotor for slowing the frequency at which said rotor rotates.

10. A modulator as in claim 4, wherein the modulator assembly produces an acoustic signal with a particular phase, and the phase of the signal is momentarily altered to modulate the phase of the acoustic signal to encode data on the acoustic signal.

11. A modulator as in claim 10, further comprising a hydraulic pump connected to said rotor and a flow control valve for controlling hydraulic fluid from said pump, wherein said flow control valve is selectively positioned in response to a signal from the encoder to change the pressure in the pump, thereby altering the torque necessary to drive the pump.

12. A modulator as in claim 11, wherein the rotor drives the pump.

13. A modulator as in claim 12, wherein the rotor slows down as the torque necessary to drive the pump increases.

14. A modulator as in claim 10, further comprising a generator and a variable resistive load across the generator, wherein the resistive load is selectively set in response to a signal from the encoder, thereby altering the torque necessary to drive the generator.

15. A modulator as in claim 14, wherein the rotor drives the generator.

16. A modulator as in claim 15, wherein the rotor slows down as the torque necessary to drive the generator increases.

17. A modulator assembly as in claim 1, further comprising;

a rachet mechanism connected to said rotor for stopping and starting said rotor in an encoded sequence to produce discrete pressure pulses.

18. A modulator assembly for an MWD system, comprising;

a housing;

a diverter mounted in said housing and including an interior fluid channel through said diverter and an exterior fluid channel between said diverter and said housing;

a stator fixedly positioned within said diverter;

a rotor positioned upstream of said stator; and a turbine fixedly positioned within said diverter upstream of said rotor such that said turbine imparts angular momentum to mud passing through said interior fluid channel.

* * * * *